US010222174B2

(12) United States Patent
Robertson et al.

(10) Patent No.: US 10,222,174 B2
(45) Date of Patent: Mar. 5, 2019

(54) HOLSTERING SYSTEM

(71) Applicants: Tracey L. Robertson, Bloomfield Hills, MI (US); Austin J. Duffy, Bloomfield Hills, MI (US)

(72) Inventors: Tracey L. Robertson, Bloomfield Hills, MI (US); Austin J. Duffy, Bloomfield Hills, MI (US)

( * ) Notice: Subject to any disclaimer, the term of this patent is extended or adjusted under 35 U.S.C. 154(b) by 0 days.

(21) Appl. No.: 15/794,258

(22) Filed: Oct. 26, 2017

(65) Prior Publication Data

US 2018/0120057 A1 May 3, 2018

Related U.S. Application Data

(60) Provisional application No. 62/413,495, filed on Oct. 27, 2016.

(51) Int. Cl.
*F41C 33/04* (2006.01)

(52) U.S. Cl.
CPC ..... *F41C 33/041* (2013.01); *F41C 33/046* (2013.01); *F41C 33/048* (2013.01)

(58) Field of Classification Search
CPC ..... F41C 33/041; F41C 33/00; F41C 33/02; F41C 33/046; F41C 33/048
See application file for complete search history.

(56) References Cited

U.S. PATENT DOCUMENTS

| | | | | |
|---|---|---|---|---|
| 5,421,497 | A * | 6/1995 | Gilmore | A45F 5/00 224/192 |
| 6,161,741 | A | 12/2000 | French | |
| 6,641,009 | B2 | 11/2003 | French et al. | |
| 6,726,072 | B2 | 4/2004 | Rugh | |
| 7,556,181 | B2 | 7/2009 | Spielberger | |
| 8,622,269 | B2 | 1/2014 | Hogue | |
| 9,265,319 | B1 | 2/2016 | Zeh-Franke | |
| 2005/0178808 | A1* | 8/2005 | Buis | F41C 33/02 224/198 |
| 2015/0144673 | A1* | 5/2015 | Dahl | F41C 33/00 224/587 |

* cited by examiner

*Primary Examiner* — Corey N Skurdal
(74) *Attorney, Agent, or Firm* — Howard & Howard Attorneys PLLC

(57) ABSTRACT

A holstering system including a base member and a holster that defines at least one opening adapted to receive and removably retain a firearm or other personal safety device. An articulating fastening mechanism removably mounts the holster to the base member. The fastening mechanism includes a first attachment member that defines an axis perpendicular to the base member and the holster and at least one second attachment member spaced from the first attachment member. The second attachment member is movable about a predetermined arcuate path relative to the axis defined by the first attachment member so as to change the angular orientation of the opening of the holster relative to the base.

14 Claims, 6 Drawing Sheets

HOLSTERING SYSTEM

CROSS-REFERENCE TO RELATED APPLICATIONS

The present application claims priority to and all the benefits of U.S. Provisional Patent Application No. 62/413,495, filed on Oct. 27, 2016, which is hereby expressly incorporated herein by reference in its entirety.

BACKGROUND OF THE INVENTION

1. Field of the Invention

The present invention relates, generally, to a holstering system for firearms and other types of crime-deterrent, accessory or outdoor recreational devices, and more specifically, to a holstering system for use with handguns or other personal safety devices, such as knives, tasers, stun guns, mace and the like.

2. Description of the Related Art

Personal safety and security concerns have caused many persons to open or conceal carry firearms and other types of crime-deterrent or outdoor recreational devices, such as knives, tasers, stun guns and chemical mace. Unfortunately, the traditional shoulder holster, while providing a practical carry method, presents many challenges with respect to concealment, comfort, and ease of use. Shoulder holsters are typically worn over at least one layer of clothing and can be very bulky requiring thicker outer garments to conceal the shoulder harnessing straps that typically extend over both shoulders and crisscross on the person's back or over one shoulder where it is ultimately operatively attached to a belt. Other holster devices known in the related art may also include a strap that crosses the front of the person's chest. The straps are usually visible to others and this fact reduces the ability for the person to conceal the fact that a holster for a handgun or other personal safety device is being worn. Moreover, a number of holstering devices of the type known in the related art are overly complicated, generally uncomfortable and often interfere with seatbelt use and do not provide a holster adapted to be orientated in the user's preferred position. Thus, holsters of the type generally known in the related art have typically not found widespread acceptance in the relevant market, except for law enforcement officers or security personnel who are authorized to carry weapons open or concealed as a function of their employment.

In particular, women have been increasingly likely to carry a weapon on their person. However, oftentimes the construction or style of women's clothing does not permit proper open or conceal carry of the firearm. In addition, a concealed handgun cannot be safely or comfortably carried in many, if not most types, of women's apparel. The holstering devices of the type known in the related art typically make it awkward, time-consuming and inconvenient to access the weapon when needed. Thus, many women opt to forego holsters of the type worn on the body in favor of a bag of some sort, such as a purse, handbag, pocketbook, etc. to store and carry items such as firearms or personal safety devices, along with personal items such as keys, money, driver's license and the like. However, these types of receptacles are usually inappropriate for carrying a firearm. Many handbags are sizable, and as noted above, are filled with a variety of items. A firearm, such as a handgun or similar self-defense weapon, is typically heavier than the other contents in the handbag and will likely fall to the bottom of the container. As a result, the firearm may be difficult and time-consuming to quickly locate, which can be very undesirable in an emergency situation. The user of the firearm may be required to fumble around and search through the bag in order to locate and retrieve the weapon. The handbag may also be grabbed from the woman, dispossessing her of her handgun.

Thus, there remains a need in the art for a handgun holstering system that is far easier and more comfortable to wear or conceal than current holstering devices available in the related art, which may be employed by both men and women, especially those favoring tailored clothing, or under a sports jacket and which allows the user to customize the orientation of the handgun relative to the user to present the grip at the preferred angle by each individual user.

SUMMARY OF THE INVENTION

The deficiencies in the related art are overcome in the present invention, which is directed toward a holstering system for firearms and other types of crime deterrent and outdoor recreational devices, such as knives, tasers, stun guns and chemical mace. The holstering system includes a base member and a holster that defines at least one opening adapted to receive and removably retain a firearm or other crime-deterrent device. The system further includes an articulating fastening mechanism for removably mounting the holster to the base. The fastening mechanism includes a first attachment member that defines an axis perpendicular to the base and the holster, as well as at least one second attachment member spaced from the first attachment member. The second attachment member is movable about a predetermined arcuate path relative to the axis defined by the first attachment member so as to change the angular orientation of the opening of the holster relative to the base.

The firearm holstering system of the present invention eliminates the need for complicated straps or other mounting systems, while allowing the user to position the holster on the body at an infinite number of positions between first and second positions defined by the first and second attachment members. This allows the user to customize the location of the firearm on the body, positioning the grip at the angle preferred by the individual user, and while maintaining the greatest amount of comfort and concealability possible. Moreover, the holstering system of the present invention allows the base member to be mounted to a person's body beneath the first layer of clothing, while further allowing the holster to be mounted to the base member outside a layer of clothing. In this way, the base member and any mounting strap associated with the base member remains fully concealed on the wearer's body and makes possession of the firearm far less noticeable. Additionally, the base member can be inserted in any pocket on the wearer and used to mount the holster without the mounting strap.

Other objects, features and advantages of the present invention will be readily appreciated as the same becomes better understood after reading the subsequent description taken in connection with the accompanying drawings.

DETAILED DESCRIPTION OF THE INVENTION

Figure 1:
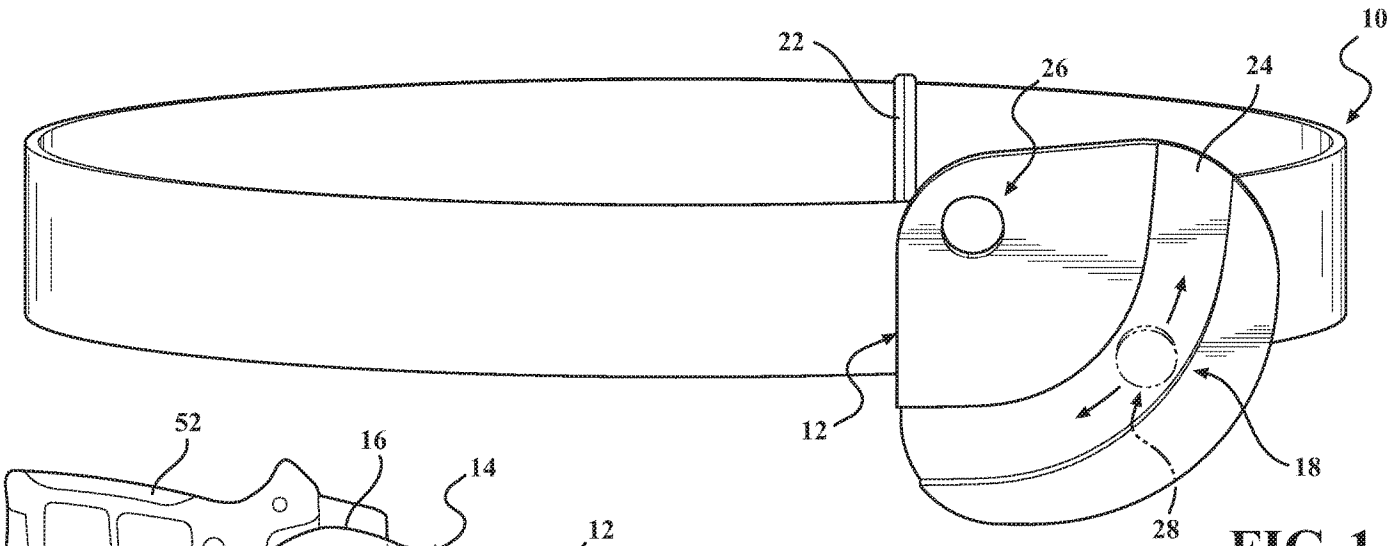
FIG. 1 illustrates a portion of the holstering system of the present invention including a base mounted to a support strap.
Figure 2:
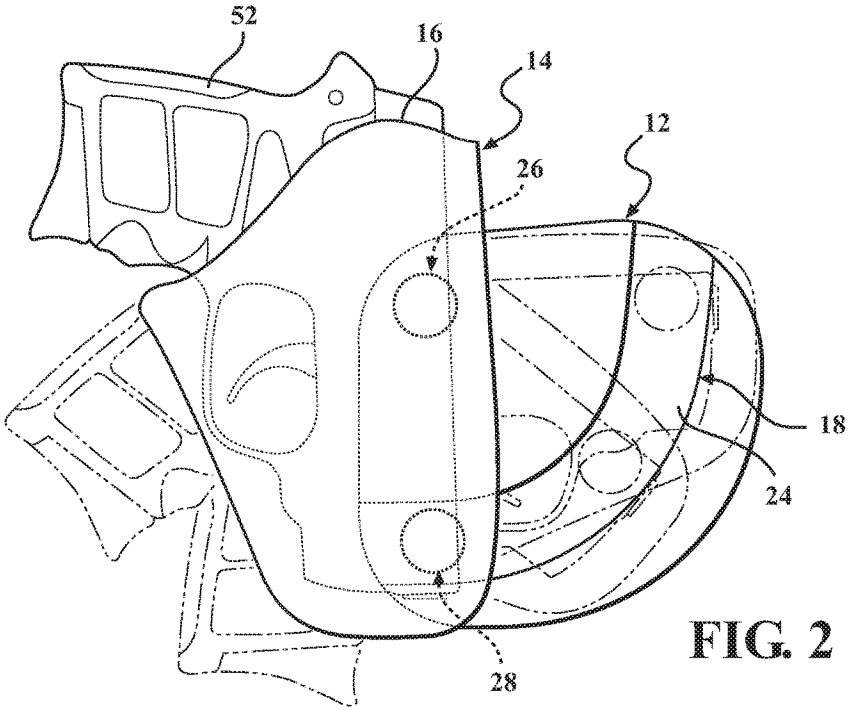
FIG. 2 illustrates a handgun operatively supported in the holster, wherein the holster is articulated between a substantially horizontal, a vertical orientation, as well as an orientation that is substantially 45° relative to the horizontal and vertical orientations.
Figure 3:
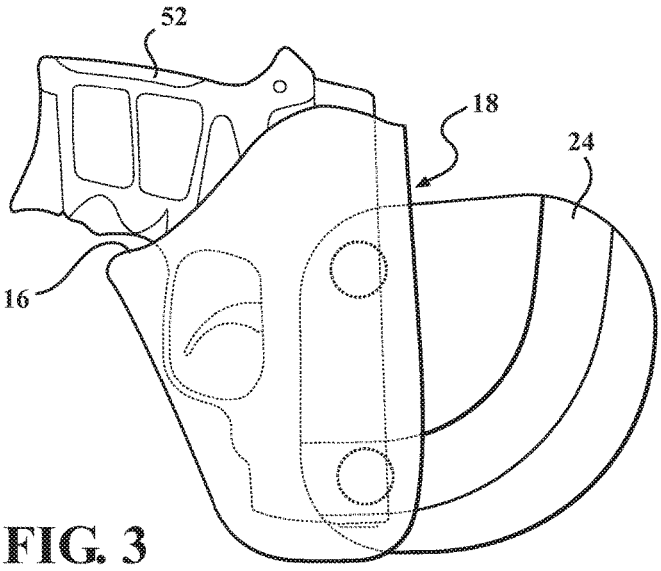
FIG. 3 illustrates a firearm supported in the holster disposed substantially vertical position.

A holstering system of the present invention, and some components thereof, is generally indicated at 10 throughout the figures, where like numerals are used to designate like structure. The holstering system 10 of the present invention may be used for firearms of any and all types, such as handguns, as well as other personal safety devices such as knives, tasers, stun guns, mace and the like and accessories such as additional magazines. Accordingly, those having ordinary skill in the art will appreciate from the following description that the present invention is in no way limited by the personal protection device that may be accommodated by the holstering system.

The holstering system 10 includes a base member generally indicated at 12, and a holster generally indicated at 14 that defines at least one opening 16 adapted to receive and removably retain a firearm or any other personal safety device of the type referenced above. In addition, the holstering system further includes an articulating fastening mechanism generally indicated at 18 for removably mounting the holster 14 to the base member 12. Each of these components will be described in greater detail below.

The holstering system 10 of the present invention may also include an optional strap 20 that can be worn about a portion of the user's body. More specifically, the strap 20 may be used to accommodate a torso, leg, or any other limb or suitable appendage or area of the human body. The strap 20 may be endless and slipped over the torso or leg, limb or other appendage, or may have a pair of ends that are operatively attached to each other using any known attachment mechanism, such as a clasp, hook and loop fastener, or the like. The individual user may elect to use the base plate in a pocket in place of the strap. Those having ordinary skill in the art will appreciate that any attachment mechanism known in the related art may be employed to operatively connect the ends of the strap 20 together. The strap 20 may also employ a cinching mechanism 22 to adjust the length thereof. As will be clear from the description that follows, the strap may be mounted directly to the user's body and under one or more layers of clothing. The strap 20 may be manufactured of high tactile silicone band-like material, water-resistant compression fabric, or any other material suitable for the purpose as described in greater detail below.

When a strap 20 is employed, the base member 12 is designed to be fixedly mounted to the strap 20. As noted above, the articulating fastening mechanism 18 is employed for removably mounting the holster 14 to the base member 12. To this end, the base member 12 includes at least one arcuate channel 24 defined therein. The fastening mechanism 18 includes a first attachment member generally indicated at 26 that operatively but removably mounts the base member 12 relative to the holster 14. The first attachment member 26 defines an axis perpendicular to the base member 12 and the holster 14. At least one second attachment member generally indicated at 28 is spaced from the first attachment member 26. The second attachment member 28 operatively but removably mounts the base member 12 relative to the holster 14. However, the second attachment member 26 is movable along the arcuate channel 24 defined by the base member 12 about a predetermined path relative to the axis defined by the first attachment member 26 so as to change the regular orientation of the opening 16 of the holster 14 relative to the base member 12 as will be described in greater detail below.

In the embodiment shown in FIGS. 9-12, the first and second attachment members 26, 28 may be defined by a corresponding pair of magnets generally indicated at 30. One of the pair of magnets 30 is operatively mounted to the base member 12 and the other of the pair of magnets is operatively mounted to the holster 14. More specifically, one of the pair of magnets 30 includes a cup-shaped member 32 and the other corresponding one of the pair of magnets includes a male member 34 that may be operatively retained relative to the cup-shaped member 32. In one embodiment, the cup-shaped member 32 may be associated with the base member 12 and the male member 34 may be associated with the holster 14. However, those having ordinary skill in the art will appreciate that the cup-shaped member 32 may be associated with the holster 14 and the male member 34 may be associated with the base member 12 without departing from the scope of the invention.

The cup-shaped member 32 includes an annular housing 36 that defines an interior compartment 38. To this end, the annular housing 36 includes an annular base 40 and annular walls 42 extending from the base 40 so as to define the compartment 38. A magnet 44 may be operatively retained within the compartment 38 to serve as one-half of the fastening mechanism. Alternatively, the entire cup-shaped member 32 may, itself, be magnetized. The pair of magnets may be made of any suitable material, such as neodymium, or any other suitable, magnetic material of the type commonly known in the related art. In addition, those having ordinary skill in the art will appreciate that the members 32 and 34 may have any suitable shape and size sufficient to operatively retain the holster to the base and allow the holster to pivot relative to the base as explained in greater detail below.

In one embodiment, the first attachment member 26 is fixed relative to the base 12 and the holster 14. On the other hand, and in one embodiment, the cup-shaped member 32 associated with the second attachment member 28 is movably supported in the channel 24 along its arcuate path as indicated by the arrows in FIG. 1, and the male member 34 associated with the second attachment member 28 is supported on the holster 14. A retention device 35 may be employed to mount the male member 34 to the holster. The male member 34 is removably retained relative to the cup-shaped base member 32 in the compartment 38 defined by the housing 36 of the cup-shaped member 32. In this way, the first attachment member 26 defines an arcuately fixed point relative to the base 12 and the holster 14 and the second attachment member 28 defines a movable fastening member such that the holster 14 may pivot about the axis defined by the first attachment member 26 as the cup-shaped member 32 associated with the second attachment member 28 moves along the arcuate path defined by the channel 24. The cooperating, annular shape of the cup-shaped member 32 and the male member 34 further facilitate the pivoting action between the base member 12 and the holster 14 at both the first and second attachment members 26, 28.

The base member 12 may include a rigid substrate made of any suitable materials such as hard plastic. The substrate may be covered or encased in another flexible material, such as cloth, leather, canvas or the like. The channel 24 may be defined between the substrate and the material encasement by sewing an arcuate pathway in the material. Alternatively, a rigid plastic U-shaped guide mechanism that conforms to the arcuate shape of the channel may also be employed to define the arcuate channel 24.

The holster 14 includes a body 46 that defines a compartment 48 that extends from the opening 16 to an end 50 such that the compartment 48 is adapted to receive the body of a firearm generally indicated at 52 in FIGS. 2-5 or other self-defense device. In one embodiment, the male members 34 associated with the first and second attachment members 26, 28 are mounted to the holster 14 in spaced relationship with respect to each other. In one embodiment, the male member 34 magnets are fixedly mounted to the holster 14. In addition, the holster 14 may also include an interior magnet 54 that is operatively disposed spaced from the opening 16 in the compartment 48. The interior magnet 54 provides a detent and removable securement mechanism for the firearm 52 or other crime-deterrent or outdoor recreational device in the compartment of the holster.

Figure 4:
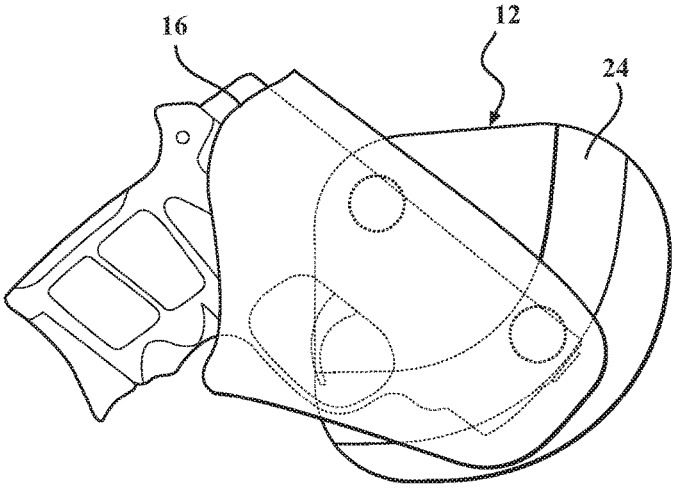
FIG. 4 illustrates a firearm supported in a holster disposed at an angle substantially 45° with respect to the vertical orientation.
Figure 5:
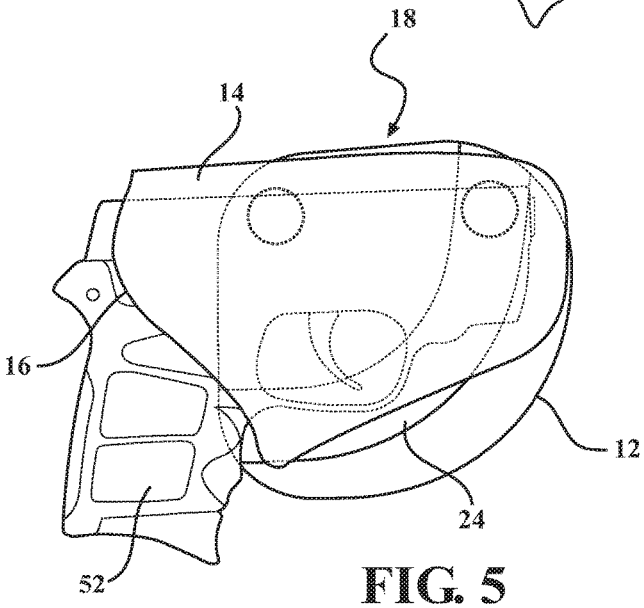
FIG. 5 illustrates a firearm supported in a holster disposed at a substantially horizontal position.
Figure 8:
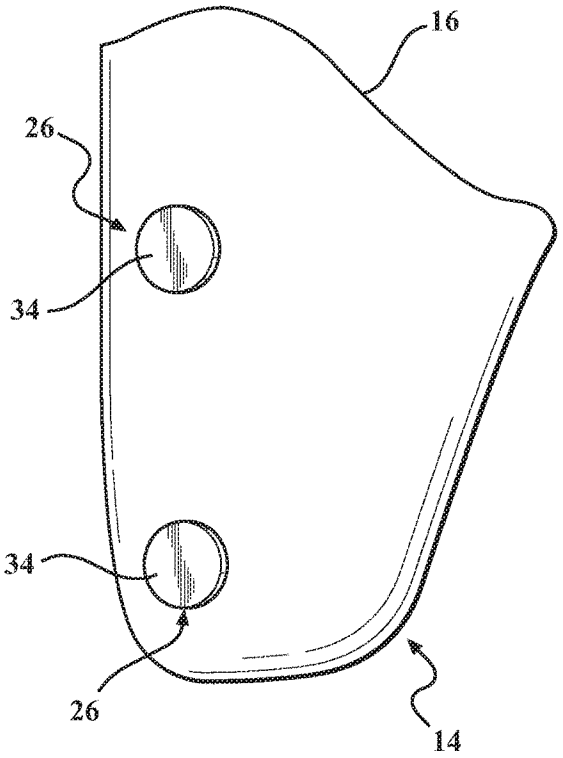
FIG. 8 is an opposite side view of the holster illustrated in FIG. 6.
Figure 7:
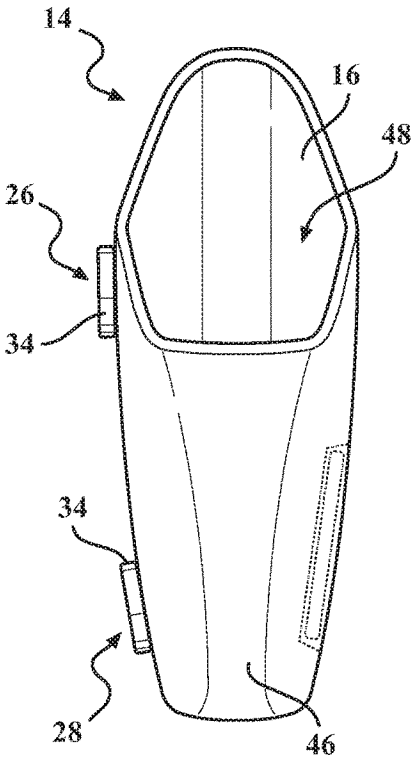
FIG. 7 is an end view of the holster.
Figure 6:
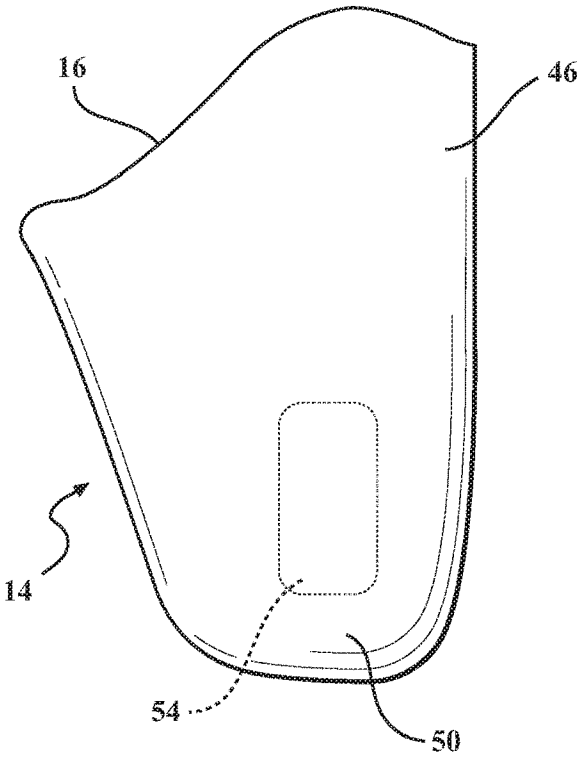
FIG. 6 is a side view of the front of the holster.
Figure 9:
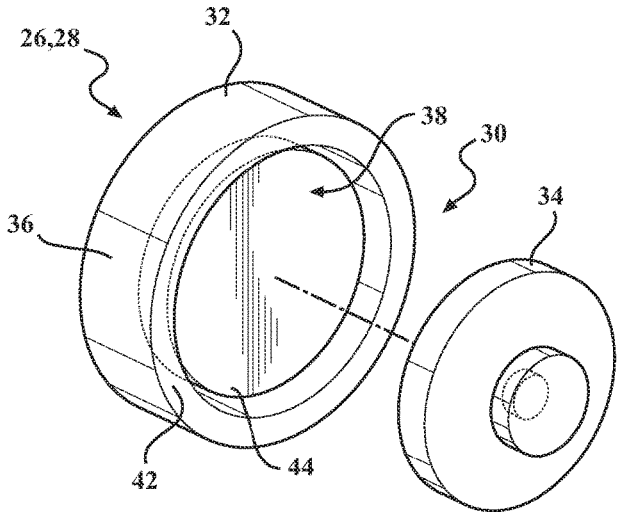
FIG. 9 is an exploded view of the first and second attachment members.
Figure 10:
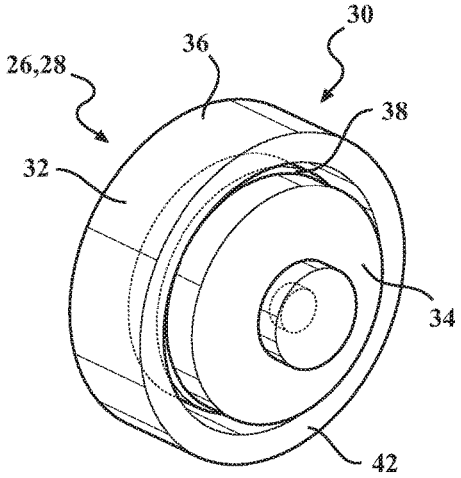
FIG. 10 is a perspective view of the first and second attachment members.

The operation of the firearm holstering system of the present invention is generally illustrated in FIGS. 2-5. There, the firearm holstering system is illustrated in connection with a handgun 52 that is operatively supported in the holster 14. As shown in these figures, the holster 14 is movable relative to the base member 12 to any of an infinite number of positions between a generally vertical orientation illustrated, for example, in FIGS. 2 and 3 relative to the base member 12 and a horizontal orientation relative to the base member 12 illustrated in FIGS. 2 and 4. For example, the holster 14 and associated handgun 52 is also shown in FIG. 4 disposed in a 45° orientation relative to either the vertical or horizontal disposition. The articulating fastening mechanism 18 including the first and second attachment members 26, 28 of the present invention facilitate this adjustability.

More specifically, while the first attachment member 26 defines an axis perpendicular to the base member 12 and is generally fixed, except for rotational movement about this axis, the second attachment member 28 spaced from the first attachment member 26 may be moved along the arcuate path defined by the channel 24 in the base member 12 such that the orientation of the holster 14, and the associated firearm 52 or other weapon, may be adjusted along this arcuate path.

Figure 11:
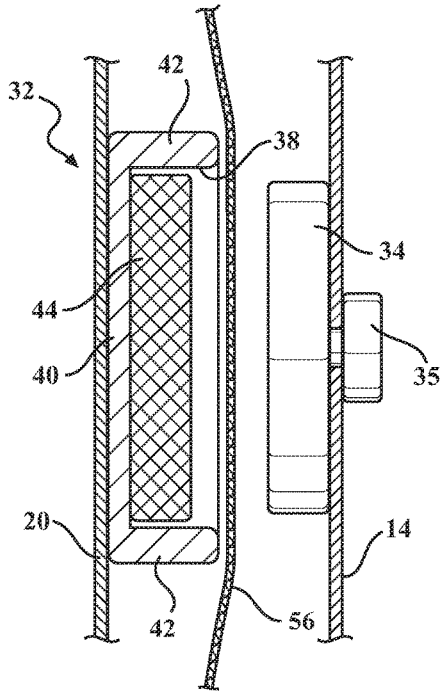
FIG. 11 is an exploded cross-sectional side view of the first and second attachment members of the present invention.
Figure 12:
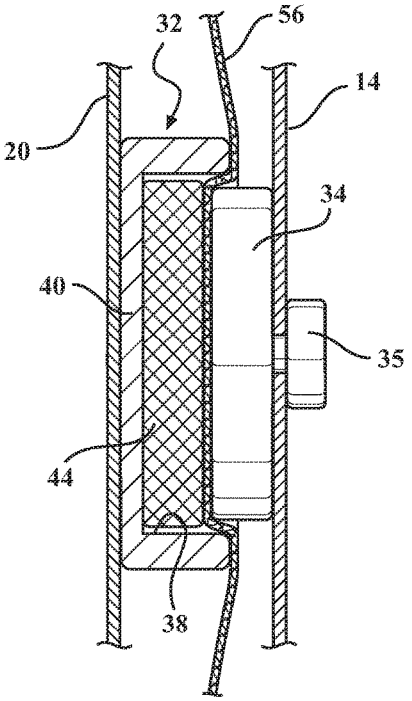
FIG. 12 is a cross-sectional side view of the first and second attachment members of the present invention.

The articulating fastening mechanism 18 of the present invention also facilitates an important feature of the present invention that is best understood with reference to FIGS. 11 and 12. More specifically, the articulating fastening mechanism 18 facilitates the use of the strap 20 beneath a layer of clothing 56 and, may even be worn on the skin of the user, while the holster 14 may be removably and rotatably mounted to the base member 12 on the opposite side of a layer of clothing 56. The use of magnets with the first and second attachment members 26, 28 facilitates this configuration and greatly improves the ability for the wearer to possess a concealed weapon, including a firearm of any type, as well as other personal security or outdoor recreational devices. In this way, the strap 20 is not visible from the exterior of even the first layer of clothing. Nevertheless, and even with a layer of clothing disposed beneath the base 12 and the holster 14, the base 12 and holster may be operatively supported with respect to each other and the first and second attachment members 26, 28 pivoted so as to adjust the position of the holster relative to its base 12 in any position desired by the user along the path of the channel 24.

Figure 13:
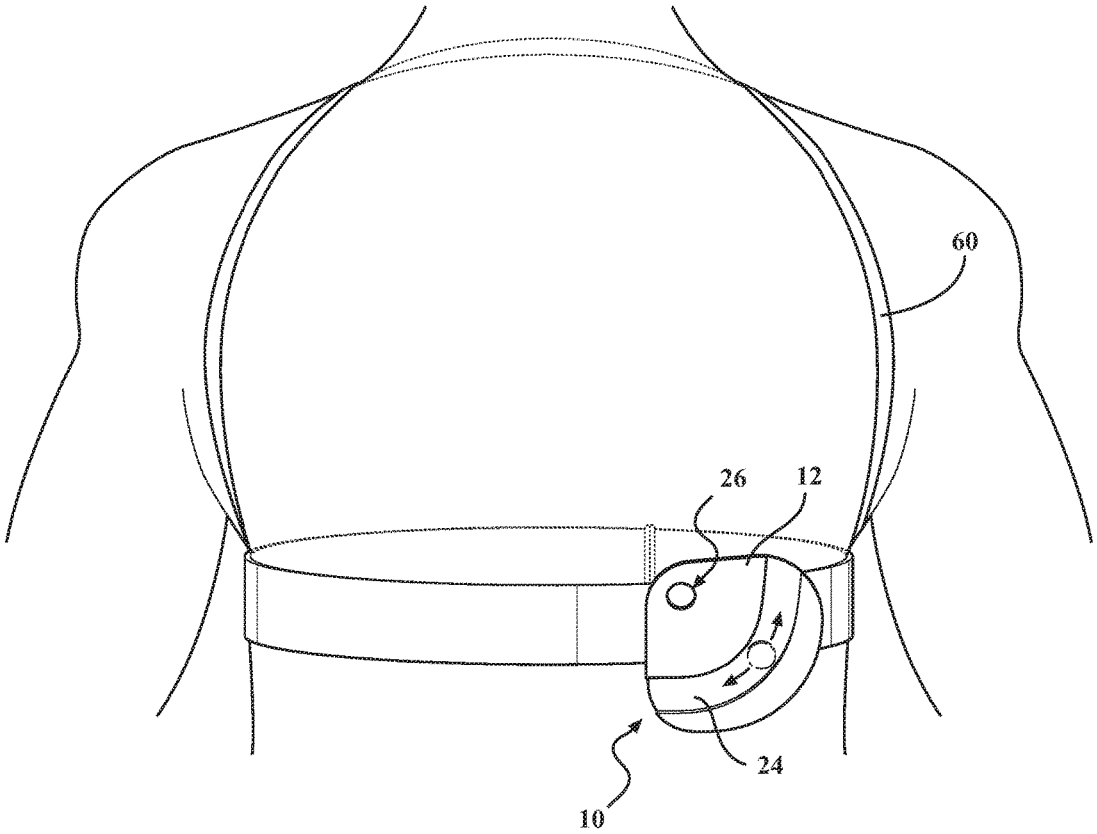
FIG. 13 is another embodiment of the firearm holstering system of the present invention shown deployed with a shoulder strap.
Figure 16:
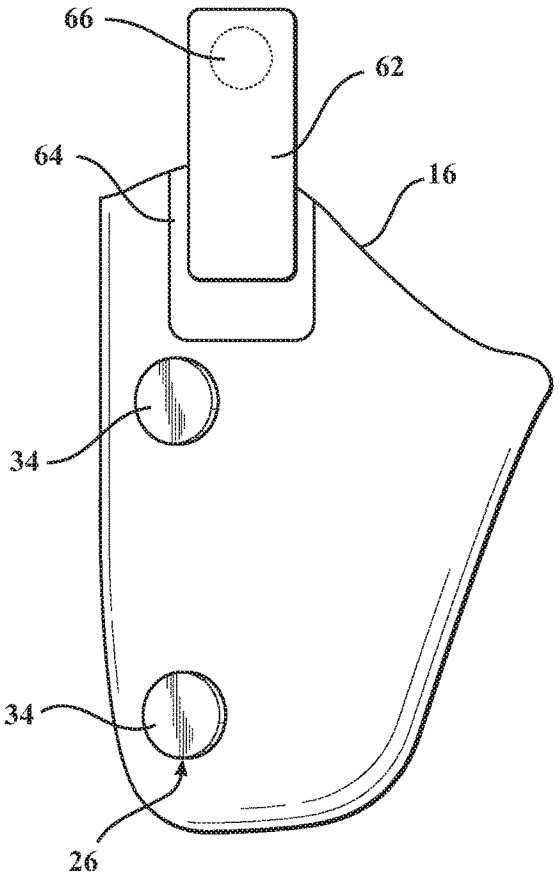
FIG. 16 is an opposite side view of the embodiment of the holstering system of the present invention illustrated in FIG. 14.
Figure 15:
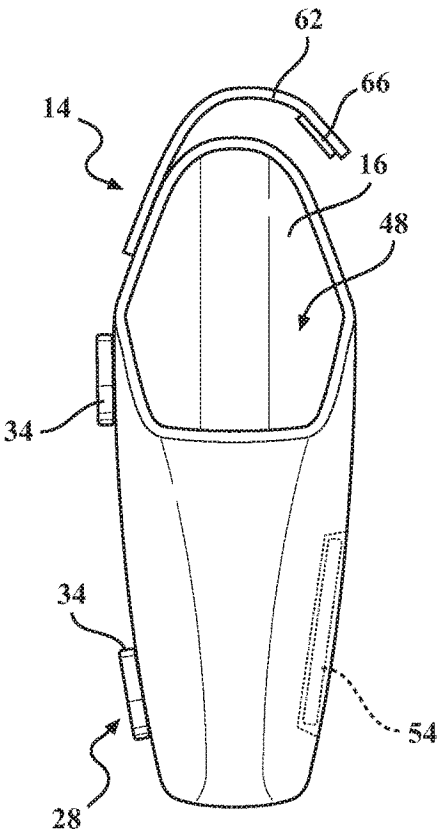
FIG. 15 is a front view of the embodiment of the holstering system illustrated in FIG. 14.
Figure 14:
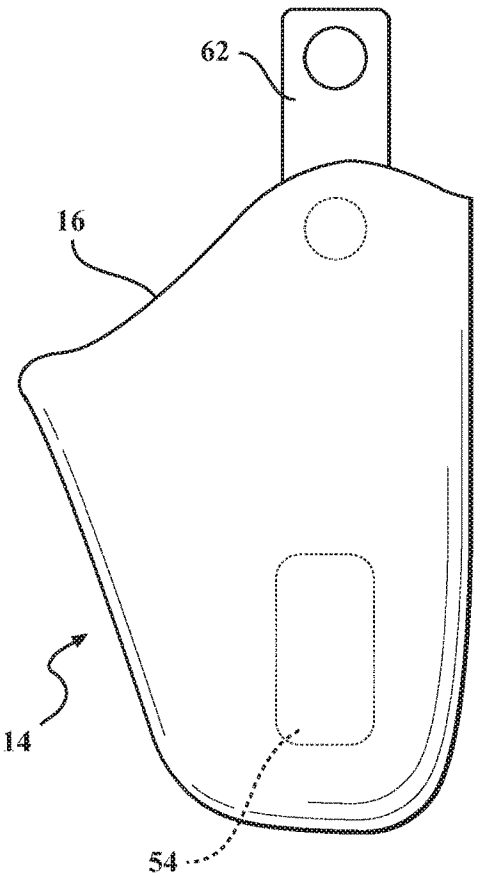
FIG. 14 is a side view of another embodiment of the holstering system of the present invention including a retention strap.

FIG. 13 shows another embodiment of the holstering system 10 of the present invention where like numerals are used to designate like structure. In FIG. 13, the holstering system 10 is deployed in conjunction with a shoulder strap 60. Similarly, FIGS. 14-16 show still another embodiment of the holstering system 10 of the present invention where like numerals are used to designate like structure. In the embodiment illustrated in FIGS. 14-16, the holstering system 10 includes a retention strap 62 designed to retain the firearm, or any other suitable self-defense device, in the holster 14. To this end, the retention strap 62 is fixed to the holster 14 using, for example, a hook and loop retention device 64, or any other suitable type fastening mechanism. The free end of the retention strap 62 may also include a magnet 66 which may be employed to removably attach the strap to the opposite side of the holster 14 from the location of the hook and loop fastening mechanism.

Thus, the flexibility of the firearm holstering system 10 of the present invention allows for the user to tuck the holster 14 in a convenient, and even concealed position, while still wearing tailored outer clothing. Moreover, and because the articulating fastening mechanism 18 allows the holster to be articulated relative to the base member 12, the user may position the firearm 52 in the most comfortable position and preferred grip angle for easy extraction and insertion with respect to the holster that the user finds convenient.

In this way, the firearm holstering system 10 of the present invention is far easier to conceal than current holstering devices available in the related art. In addition, the present invention may be employed by both men and women, especially those favoring tailored clothing, and allows the user to customize the orientation of the handgun relative to the user. Finally, the firearm holstering system of the present invention may be worn about the torso, under the first layer of clothing, on a leg, arm, or any other limb.

The invention has been described in an illustrative manner. It is to be understood that the terminology which has been used is intended to be in the nature of words of description rather than of limitation. Many modifications and variations of the invention are possible in light of the above teachings. Therefore, within the scope of the appended claims, the invention may be practiced other than as specifically described.

What is claimed is:

1. A holstering system comprising:

a base member including an arcuate channel defined on said base and a holster that defines at least one opening adapted to receive and removably retain a firearm or other personal safety device;

an articulating fastening mechanism for removably mounting said holster to said base member, said fastening mechanism including a first attachment member that defines an axis perpendicular to said base member and said holster and at least one second attachment member spaced from said first attachment member, said second attachment member including a cup-shaped base member movably supported in said channel along its arcuate length and a male member supported on said holster that is removably retained relative to said cup-shaped base member, said second attachment member being movable about a predetermined arcuate path relative to said axis defined by said first attachment member so as to change the angular orientation of said opening of said holster relative to said base.

2. The holstering system as set forth in claim 1, wherein said first attachment member is arcuately fixed relative to said base member and said holster but allows pivoting of said holster relative to said base about said axis.

3. The holstering system as set forth in claim 1, wherein said male member is fixedly mounted to said holster.

4. The holstering system as set forth in claim 1, wherein said first attachment member is defined by a corresponding pair of magnets, one of said pair of magnets is mounted to said base member and the other of said pair of magnet is mounted to said holster.

5. The holstering system as set forth in claim 4, wherein at least one of said pair of magnets is cup-shaped and the other of said pair of magnets defines a male member that may be operatively retained relative to the other cup-shaped magnet.

6. The holstering system as set forth in claim 1, wherein said system further includes a strap adapted to be worn about a portion of the user's body, said base operatively mounted to said strap, said attachment member including a pair of magnets with one of said pair mounted to said base member and the one of said pair mounted to said holster, and said holster removably and removably mounted to said base through said magnetic attachment members.

7. The holstering system as set forth in claim 1, wherein said holster includes a compartment that extends from said opening to an end so as to define a compartment that is adapted to receive the body of a firearm or other crime-deterrent or recreational device, and an interior magnet operatively disposed spaced from said opening in said compartment for providing a detent and removable securement of the firearm or other crime-deterrent or recreational device in said compartment of said holster.

8. A firearm holstering system comprising:

a strap that can be worn about a portion of the user's body, a base member operatively mounted to said strap, said base including an arcuate channel defined on said base and a holster that defines at least one opening adapted to receive and removably retain a firearm;

an articulating fastening mechanism for removably mounting said holster to said base member, said fastening mechanism including a first attachment member that defines an axis perpendicular to said base member and said holster and at least one second attachment member spaced from said first attachment member, said second attachment member including a cup-shaped base member movably supported in said channel along its arcuate length and a male member supported on said holster that is removably retained relative to said cup-shaped base member, said second attachment member being movable about a predetermined arcuate path relative to said axis defined by said first attachment member so as to change the angular orientation of said opening of said holster relative to said base.

9. The firearm holstering system as set forth in claim 8, wherein said first attachment member is arcuately fixed relative to said base and said holster but allows pivoting of said holster relative to said base about said axis.

10. The firearm holstering system as set forth in claim 8, wherein said base member is mounted to said holster.

11. The firearm holstering system as set forth in claim 8, wherein said first attachment member is defined by a corresponding pair of magnets, one of said pair of magnets is operatively mounted to said base member and the other of said pair of magnet is operatively mounted to said holster.

12. The firearm holstering system as set forth in claim 11, wherein at least one of said pair of magnets is cup-shaped and the other of said pair of magnets defines a male member that may be operatively retained relative to the other cup-shaped magnet.

13. A firearm holstering system comprising:

a base member having at least one arcuate channel defined therein and a holster that defines at least one opening adapted to receive and removably retain a firearm;

an articulating fastening mechanism for removably mounting said holster to said base member, said fastening mechanism including a first attachment member arcuately fixed relative to said base member but allows pivoting of said holster relative to said base about said axis and said holster and that defines an axis perpendicular to said base member and said holster and at least one second attachment member spaced from said first attachment member, said second attachment member being movable along said arcuate channel defined in said base member about a predetermined path relative to said axis defined by said first attachment member so as to change the angular orientation of said opening of said holster relative to said base member;

wherein said first and second attachment members are defined by a corresponding pair of magnets, one of said pair of magnet is operatively mounted to said base and the other of said pair of magnets is operatively mounted to said holster; and wherein at least one of said pair of magnet is cup-shaped and the other of said pair of magnets defines a male member that may be operatively retained relative to the other cup-shaped magnet.

14. The firearm holstering system as set forth in claim 13, wherein said holster includes a compartment that extends from said opening to an end so as to define a compartment that is adapted to receive the body of a firearm or other crime-deterrent device, and an interior magnet operatively disposed spaced from said opening in said compartment for providing a detent and removable securement of the firearm or other crime-deterrent device in said compartment of said holster.

* * * * *